United States Patent [19]

Minor

[11] Patent Number: 4,616,591

[45] Date of Patent: Oct. 14, 1986

[54] FLOATATION, SPLASHLESS CANOE MOTOR MOUNT

[76] Inventor: John M. Minor, 9340 Lee Smith Dr., Juneau, Ak. 99801

[21] Appl. No.: 724,536

[22] Filed: Apr. 18, 1985

[51] Int. Cl.[4] ..... B63B 35/71

[52] U.S. Cl. ..... 114/347; 440/900; 248/641

[58] Field of Search ..... 440/6, 49, 900; 114/61, 114/123, 347; 248/640, 641

[56] References Cited

U.S. PATENT DOCUMENTS

| | | | |
|---|---|---|---|
| 1,141,196 | 6/1915 | McLaren | 440/113 |
| 1,663,260 | 3/1928 | Mould | 248/641 |
| 3,789,792 | 2/1974 | Smith | 440/6 |
| 4,382,574 | 5/1983 | Ellestad | 440/900 |

FOREIGN PATENT DOCUMENTS

| | | | |
|---|---|---|---|
| 1294256 | 4/1969 | Fed. Rep. of Germany | 440/113 |

*Primary Examiner*—Trygve M. Blix

*Assistant Examiner*—Stephen P. Avila

[57] ABSTRACT

The invention described in the specifications is a canoe motor mount having a floatation body and spray rail attached forward of a transom board. The floatation body is 26 inches long by 12 inches wide by 9 inches deep and is constructed of 4 plys of fiberglas lamination (it may also be constructed of injection molded plastic or stamped aluminum). The transom board is 10 inches wide by 11 inches deep and is cut from ¾ inch exterior plywood. The claim is made that the use of a floatation body and spray rail is a unique improvement to existing art. Existing art is typified by the transom board shown in the drawing.

1 Claim, 3 Drawing Figures

FLOATATION, SPLASHLESS CANOE MOTOR MOUNT

SUMMARY

The invention is a canoe motor mount incorporating a streamlined floatation body in front of the motor transom. A rim overhangs the top outside edge of the flotation body to act as a spray rail. The net result is a mount that is less likely to cause the canoe to roll from the weight of the motor hung overboard and water is not scooped into the canoe in heavy seas as it is with other designs (waves are deflected by the spray rail).

DRAWINGS

DETAILED DESCRIPTION

Figure 1:
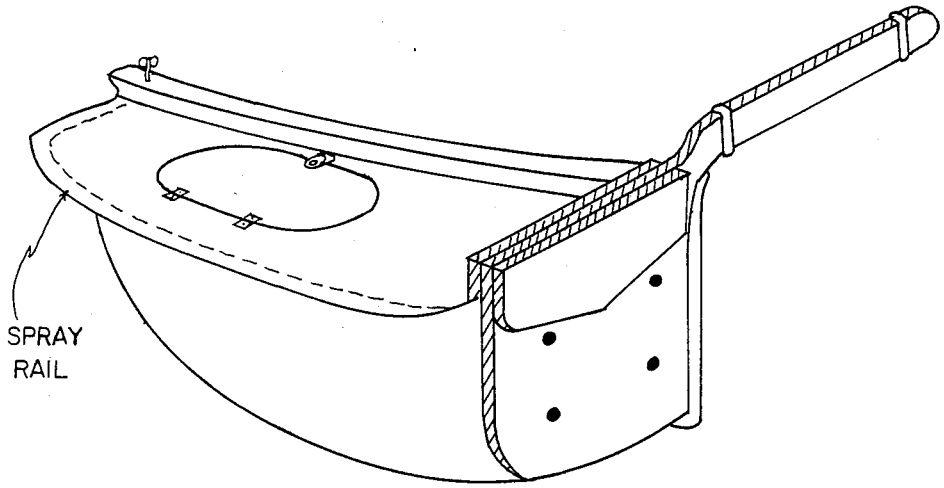
FIG. 1 is an overall perspective from the left rear.
Figure 2:
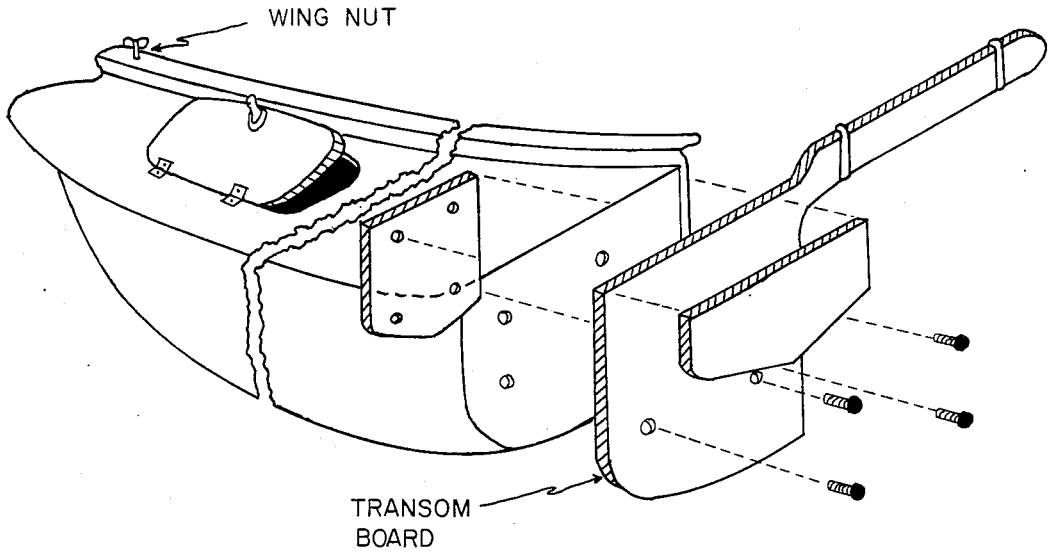
FIG. 2 is an exploded view from the left rear.

The floatation body of the mount is 26 inches long by 12 inches wide by 9 inches deep (all dimensions at the longest, widest and deepest points). An outside overhang of 1½ inches on the top surface acts as a spray rail (FIG. 1). The prototype was constructed of 4 laminations of fiberglas/polyester resin laid up over a wax coated plug of styrofoam. an 8 inch by 5 inch access hole was then cut in the top and the foam was dug out through this hole. The top piece removed was used as a hinged cover (FIG. 2). Production models will be made of injection molded cycolac plastic or stamped aluminum.

Figure 3:
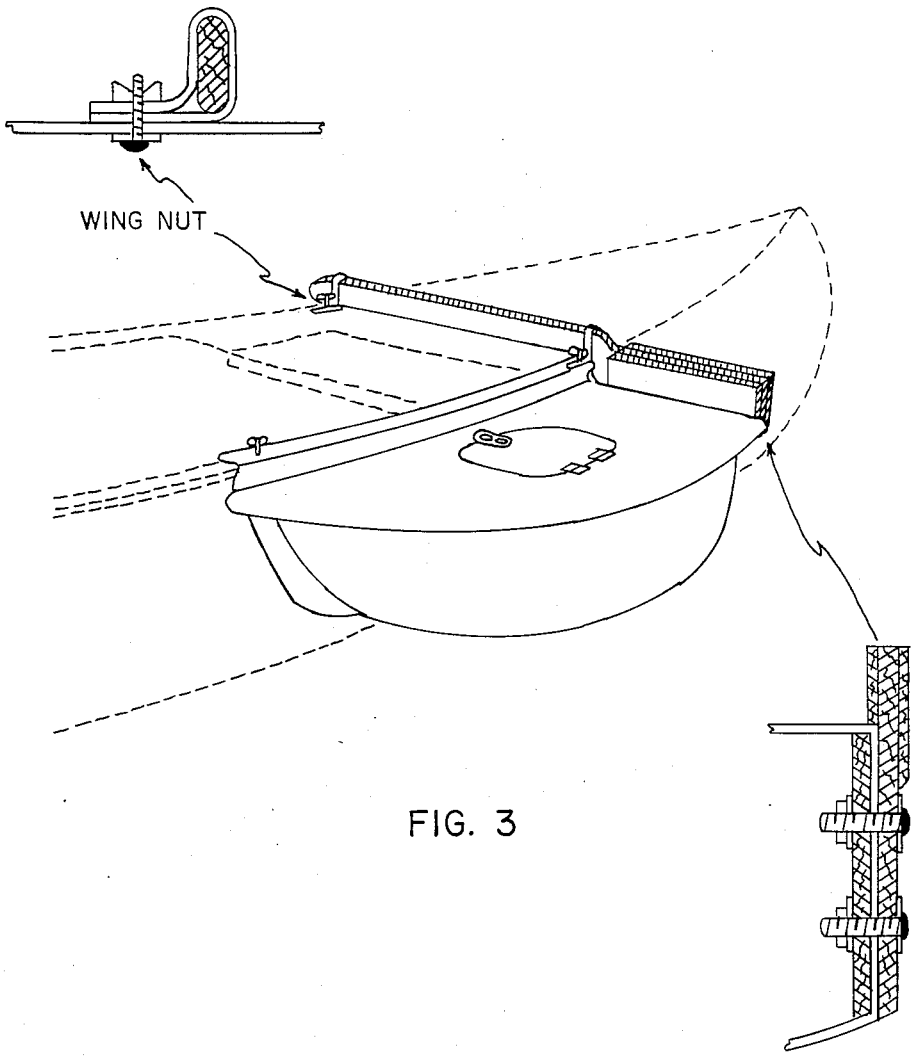
FIG. 3 is a perspective from the left front showing how the mount fastens to the canoe and how the transom board fastens to the floation body.

The transom board is of ¾ inch exterior grade plywood partially covered on both sides by protective, replaceable shims of ½ inch plywood (FIGS. 1, 2 and 3.) The transom board measures 10 inches wide by 11 inches deep with a 20 inch long by 1.5 inch wide leg spanning both canoe gunwales (FIG. 3). The transom board is fastened to the floatation body with 4 brass bolts (¼ inch diameter) through the fiberglas lamination and through an interior re-inforcing layer of ¾ inch marine plywood (FIGS. 2 and 3). Wingnuts and bolts (⅛ inch diameter, brass) are used to fasten the whole assembly to the side of the canoe next to the rear seat (FIG. 3). At the transom board, the wingnuts fasten through brass band (½ inch wide) formed around the leg of the transom board. The bolts pass through the canoe gunwales as well as the brass bands. The third wing nut fastens through a ledge of the floatation body which overlaps the canoe gunwale (FIGS. 2 and 3). The floatation body is streamlined providing a relatively smooth transition from the canoe side (FIG. 3).

The transom board by itself would be considered old or existing art and it is shown and described in detail here only to demonstrate the the feasibility of attaching a floatation body. Existing art in this area is typically a pipe bolted across both gunwales overhanging the canoe by about 10 inches. A die cast aluminum plate is fastened to the overhang of pipe and then the outboard motor is clamped to the plate. A good example of this art is U.S. Pat. No. 4,382,574 (Ellestad). The trouble with this kind of motor mount, is that the overhanging plate or transom will scoop water into the canoe when waves strike and the weight of the motor hanging overboard will tend to make some canoes more prone to roll. The addition of a floatation body with a spray rail eliminates both problems. The concept of a floatation body was first brought forward by Mclaren in 1915 (U.S. Pat. No. 1,141,196); but this was a rear mounted, movable apparatus which in its raised position, most likely would render the canoe more tippy.

I claim:

1. A floatation, splashless motor mount designed to be fastened to the side of a canoe by means of wing nuts and bolts through the metal reinforcing bands of the mount and the canoe gunwales, said mount comprising a transom board extending across both gunwales and fastened to both gunwales and a streamlined floatation body providing a relatively smooth transition from the canoe side and being fastened to the near side gunwale through a lip overhanging the gunwale and fastened to the transom board by means of bolts through the transom board and the floatation body; the floatation body having an access door to its hollow interior to service the transom bolts and to allow storage of light tackle and floatation body also having an overhanging rim on the outside top perimeter to deflect waves and splashes; the transom board having sufficient free margin protruding vertically from the attachment point with the floatation body to accomodate the clamping devices of typical portable outboard motors.

* * * * *